US008724432B2

(12) United States Patent
Courvoisier et al.

(10) Patent No.: US 8,724,432 B2
(45) Date of Patent: May 13, 2014

(54) TIMEPIECE WITH A MODULAR ANALOGUE DISPLAY

(75) Inventors: Raphael Courvoisier, Montmollin (CH); Roman Egli, Oensingen (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 116 days.

(21) Appl. No.: 13/273,663

(22) Filed: Oct. 14, 2011

(65) Prior Publication Data

US 2012/0092967 A1 Apr. 19, 2012

(30) Foreign Application Priority Data

Oct. 18, 2010 (EP) ..... 10187896

(51) Int. Cl.
*G04B 19/24* (2006.01)
*G04B 25/00* (2006.01)

(52) U.S. Cl.
USPC ..... 368/220; 368/80; 368/223

(58) Field of Classification Search
USPC ..... 368/223, 228, 231, 238, 80
See application file for complete search history.

(56) References Cited

U.S. PATENT DOCUMENTS

| | | | | |
|---|---|---|---|---|
| 3,595,011 | A * | 7/1971 | Nicholson et al. | 59/8 |
| 5,043,955 | A * | 8/1991 | Dubois et al. | 368/228 |
| 6,975,562 | B2 * | 12/2005 | Lizzi | 368/69 |
| 7,215,603 | B2 * | 5/2007 | Koike | 368/223 |
| 2004/0027926 | A1 * | 2/2004 | Haselberger | 368/223 |
| 2005/0007888 | A1 * | 1/2005 | Jolidon | 368/110 |
| 2006/0126442 | A1 * | 6/2006 | Hirano et al. | 368/223 |
| 2006/0140057 | A1 | 6/2006 | Hirano et al. | |
| 2007/0008823 | A1 * | 1/2007 | Plancon | 368/28 |
| 2009/0040879 | A1 * | 2/2009 | Galie et al. | 368/228 |

(Continued)

FOREIGN PATENT DOCUMENTS

| | | |
|---|---|---|
| EP | 0 620 509 A1 | 10/1994 |
| EP | 1 102 135 A1 | 5/2001 |

(Continued)

OTHER PUBLICATIONS

European Search Report issued Mar. 28, 2011, in European Application No. 10187896, filed Oct. 18, 2010.

*Primary Examiner* — Amy Cohen Johnson
*Assistant Examiner* — Matthew Powell
(74) *Attorney, Agent, or Firm* — Oblon, Spivak, McClelland, Maier & Neustadt, L.L.P.

(57) ABSTRACT

The invention relates to a timepiece with an analogue display, including a timepiece movement (1) provided with a mechanical output, located on an arbour (2) of said movement, and a display assembly (30) provided with at least one time display device (31, 32, 111, 112) driven by said mechanical output, wherein the display assembly is separate from the timepiece movement (1) and linked to a fixed part (10) of said movement (1) by support means which enables said display device to take several different positions around the output arbour (2) of the movement. According to the invention, the support means of the display assembly includes an intermediate support (34, 70, 72, 70') secured to the fixed part (10) of the timepiece movement (1) and provided with support members (36, 87, 89, 87', 89') allowing said at least one display device (31, 32, 111, 112) to be assembled in several positions on the intermediate support (34, 70, 72, 70'). The invention concerns the field of timepiece display members.

22 Claims, 10 Drawing Sheets

(56) References Cited

U.S. PATENT DOCUMENTS

| | | | | |
|---|---|---|---|---|
| 2010/0220559 | A1* | 9/2010 | Galie et al. | 368/220 |
| 2010/0290321 | A1 | 11/2010 | Martinez et al. | |
| 2011/0038233 | A1 | 2/2011 | Martinez et al. | |

FOREIGN PATENT DOCUMENTS

| | | | |
|---|---|---|---|
| EP | 1 672 437 | A2 | 6/2006 |
| EP | 2 085 833 | A1 | 8/2009 |
| WO | WO 2006/078080 | A2 | 7/2006 |

* cited by examiner

TIMEPIECE WITH A MODULAR ANALOGUE DISPLAY

This application claims priority from European Patent Application No. 10187896.5 filed Oct. 18, 2010, the entire disclosure of which is incorporated herein by reference.

FIELD OF THE INVENTION

The invention relates to a timepiece with an analogue display, including a timepiece movement, provided with a mechanical output located on an arbour of said movement, and a display assembly, provided with at least one time display device driven by said mechanical output, wherein the display assembly is separate from the timepiece movement and linked to a fixed part of said movement by support means, which enables said display device to take several different positions around the output arbour of the movement.

BACKGROUND OF THE INVENTION

In order to achieve rational production of different watch models, manufacturers use the same timepiece movement model (also called a "calibre") in a known manner, in combination with various display assemblies. Each of these assemblies includes the desired display members (hour, minute and seconds hands, date indicators, chronograph hands, etc.) and the gear trains necessary for driving these members from one or several mechanical outputs of the movement. This assembly is commonly called a "module", because it is often meant to be able to be replaced by a different module in the same timepiece movement, called the "basic movement".

For the purpose of varied production, the use of a distinct display module for the basic movement means, in particular, that an off-centre display device, for example a small seconds display, can be used, or the module can be changed to change the display type, for example a retrograde hand, or to add a display device, for example a 24 hour display, without the requirement to develop a new movement each time.

However, this type of module is devised for one or several predefined display functions and, if one wishes to produce a modified watch model, the display module evidently has to be modified, which involves re-engineering the module and complicating production and storage by increasing the number of component references.

SUMMARY OF THE INVENTION

It is an object of the present invention to overcome all or part of the aforecited drawbacks by proposing a modular display system for timepieces and, particularly for watches, offering increased modularity so as to allow one or several display devices of different types to be mounted on a single basic movement model, the output of which drives the display assembly. The display system according to the invention, which may be called "configurable", maintains a modular design while providing additional flexibility as regards the positioning of the display devices, and the diversity and combination thereof.

The invention therefore relates to a timepiece with an analogue display including a timepiece movement, provided with a mechanical output located on an arbour of said movement, and a display assembly, provided with at least one display device driven by said mechanical output, wherein the display assembly is separate from the timepiece movement and linked to a fixed part of said movement by support means, which enables said display device to take several positions around the output arbour of the movement. The invention is characterized in that the support means for the display assembly includes an intermediate support, which is secured to the fixed part of the timepiece movement and provided with support members allowing said at least one display device to be mounted in several positions on the intermediate support.

The addition of an intermediate support, capable of being fixed by conventional means onto the fixed part of the basic movement, offers a large number of assembly positions for one or several display devices. Further, the display devices may be of different types and be formed by individual elements devised to be secured to multi-purpose support members incorporated in the intermediate support. The system thus allows a multitude of display variants without changing any mechanical parts on the same basic movement. Advantageously according to the invention, it is clear that the presence of control and/or correction means such as, for example, a crown, is no longer an obstacle to the positioning of display members on the timepiece.

In accordance with other advantageous features of the invention:

- in three embodiments, the mechanical output includes a seconds arbour surrounded by a cannon-pinion;
- the timepiece includes at least two display devices;
- in a first embodiment, the intermediate support includes an at least partially circular rail, which is centred on the output arbour of the timepiece movement;
- said support members include orifices fitted to the rail for securing and/or positioning each display device;
- the orifices are arranged around the output arbour at a predetermined angular pitch so as to offer many possible positions for each display device;
- each display device is fixed to said rail and is meshed with a wheel of said mechanical output to display at least one time value;
- in second and third embodiments, the intermediate support includes a frame having a central aperture opposite said mechanical output;
- in a second embodiment, at least one bridge is mounted at a distance from the frame, with at least one display device being mounted in the space between said at least one bridge and said frame;
- said support members include at least one series of holes in said frame and at least one series of holes in said at least one bridge for securing and/or positioning each display device;
- the series of holes are distributed around the output arbour at a predetermined angular pitch so as to offer many possibilities for positioning each display device;
- said support members include a second series of holes in said frame and in said at least one bridge at a predetermined angular pitch so as to offer even more possibilities for positioning each display device;
- the frame and said at least one bridge are secured together to the fixed part by means of screws that each pass through said at least one bridge and the frame;
- in a third embodiment, said support members include at least one series of holes in the bottom part of the frame and at least one series of holes in the top part of the frame for securing and/or positioning each display device;
- the series of holes are distributed around the output arbour at a predetermined angular pitch so as to offer many possibilities for positioning each display device;
- said support members include a second series of holes in the top part of the frame so as to each communicate with one of said holes formed in the bottom part of the frame;

the frame is fixed to the fixed part by means of screws in at least one hole of the frame;

in the second and third embodiments, the support members are able to receive an arbour and/or a tube and/or a bearing;

in the three embodiments, each display device is meshed with a wheel of said mechanical output to display at least one time value;

at least one part of the display assembly is integral with the fixed part of the timepiece movement;

the angular pitch is less than or equal to 30°;

the timepiece movement includes a drive mechanism for a calendar display member and the calendar display member is shifted relative to the plane of said drive mechanism by a space that substantially corresponds to the thickness of the display assembly, so that the display of said calendar is presented as close as possible to said analogue display.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 11:
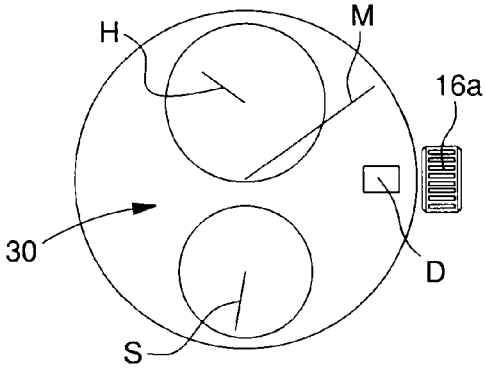
Figure 12:
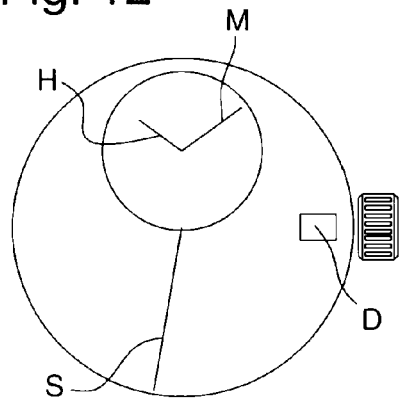
Figure 13:
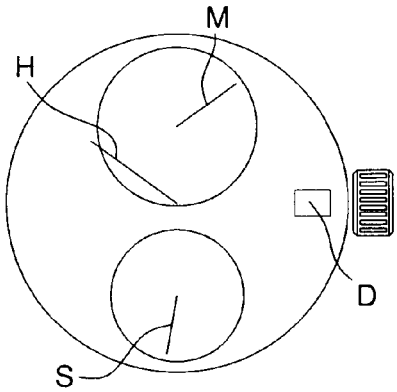
Figure 14:
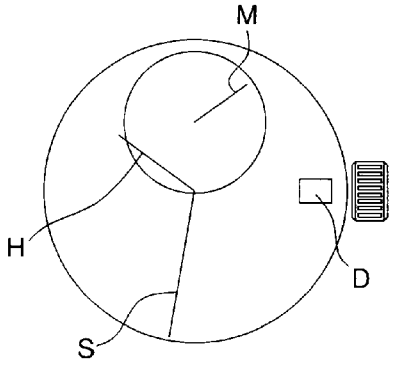
Figure 15:
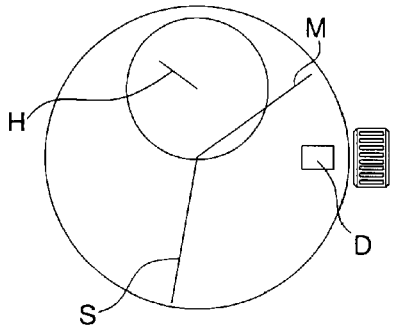

The example embodiment illustrated in FIGS. 1 to 4 includes a "regulator" type time display, shown schematically in FIG. 11, with a minute hand M at the centre, an off-centre hour hand H, which is shorter than the minute hand, and a seconds hand S, which is a small seconds hand here and is off-centre opposite the hour hand. Advantageously according to the invention, it will be seen hereinafter that the arbours of hands H, M and S, which are aligned in FIG. 11, may be positioned totally independently of each other.

A calendar display is also provided, including a date disc here, which appears in an aperture D in the dial. As is usual, the designer may place this aperture in any position on the periphery of the dial. Of course, it is also possible to display the date using another type of display member, such as, for example, a hand.

As mentioned hereinbefore, the timepiece, in the case described here a watch, includes a a common type of basic movement 1, and various display devices which are driven by said movement 1 but can be arranged in various configurations in order to make watches having different display members with the same mechanical components. Basic movement 1 may be any mechanical or electromechanical timepiece movement, such as, for example, a quartz movement.

Basic movement 1 thus includes a mechanical output with a geometrical arbour 2, in general a cannon-pinion and, in the Figures presented hereinbefore, a seconds arbour inside the cannon-pinion. Among the elements of basic movement 1 which appear in a first embodiment illustrated in FIGS. 1 to 4, the following may be mentioned: a fixed part 10, in this case a bottom plate, a seconds arbour 11 fitted with a seconds wheel 12 and guided by means of a fixed tube 9, a cannon-pinion 13, a cannon-pinion drive wheel 14 and an hour wheel 15 driven by the toothing 13*a* of cannon-pinion 13 via the usual motion work (not shown in the drawings). Also seen are a control stem 16, provided with a crown 16*a*, and a corrector wheel 17 and intermediate corrector wheel 18, which are controlled by stem 16.

Consequently, the seconds arbour 11 and cannon-pinion 13 form the mechanical output for driving the time display. In the example of FIGS. 1 to 4, it is noted that the mechanical output is at the centre of movement 1, advantageously according to the invention. This is not, however, a compulsory feature. It is thus clear that the hour wheel 15 of basic movement 1 is not used directly for the time display, i.e. no hand is secured thereto. However, hour wheel 15 is used, in a known manner, for driving the calendar display in the usual manner by the insertion of a wheel (not shown in the drawings) completing one revolution per day and, according to the invention, for driving at least one display device.

In FIGS. 1 to 7, the calendar display is formed by means of a date ring 20. This ring is in two stages here, with two annular discs 21 and 22 connected by pillars 23. In a usual manner, movement 1 includes a bottom disc 21 provided with an internal toothing and slidably mounted on plate 10. According to the invention, the calendar display surrounds the display devices and includes a second annular disc 22 mounted on the first disc 21 in the space between pillars 23 which substantially corresponds to the thickness of the display assembly, so as to display said calendar on the second annular disc as close as possible to said analogue display, i.e., as seen in FIGS. 8 to 18, as close as possible to aperture D. Consequently, in the example of FIGS. 1 to 7, as the calendar display shows the date, the top face of disc 22 carries thirty one days of the month.

The current time is indicated by means of a time display assembly 30 (indicated in FIG. 11) including at least one display device and, preferably, two independent display devices, each of which is driven individually by the output of basic movement 1 and secured to a fixed part 10 of movement 1, in this case the plate, by support means. A first device may thus be driven from cannon-pinion 13 and display the hour and minute, by means of hand H and hand M. The second device can be driven from the seconds arbour 11 and display the seconds by means of hand S. However, it is entirely possible to envisage a single display device that can drive the three hands H, M, S or display less information.

In the example of FIGS. 1 to 4, showing a first embodiment, hand H is off-centre at 12 o'clock, hand M is in the centre and hand S forms a small seconds hand at 6 o'clock. This display configuration is shown in FIG. 11. According to the first embodiment, the display assembly includes two display devices 31 and 32 which are connected to a fixed part 10 of movement 1, in this case the plate, by support means. The support means includes an intermediate support and support members.

Preferably, the intermediate support is formed by an at least partially circular rail 34 which is centred relative to arbour 2 and fixed to fixed part 10 by screws 35. Rail 34 has a flat shape here. In addition to top and lateral surfaces, the support members include, in this case, twelve staged orifices 36 able to receive screw feet 37 for fixing at least one display device to rail 34 in various positions, as the designer chooses. In the example of FIGS. 1 to 4, orifices 36 are regularly spaced at an angular pitch P which is 30° here. The designer thus has twelve possible positions for each display device 31, 32 of display assembly 30.

Figure 1:
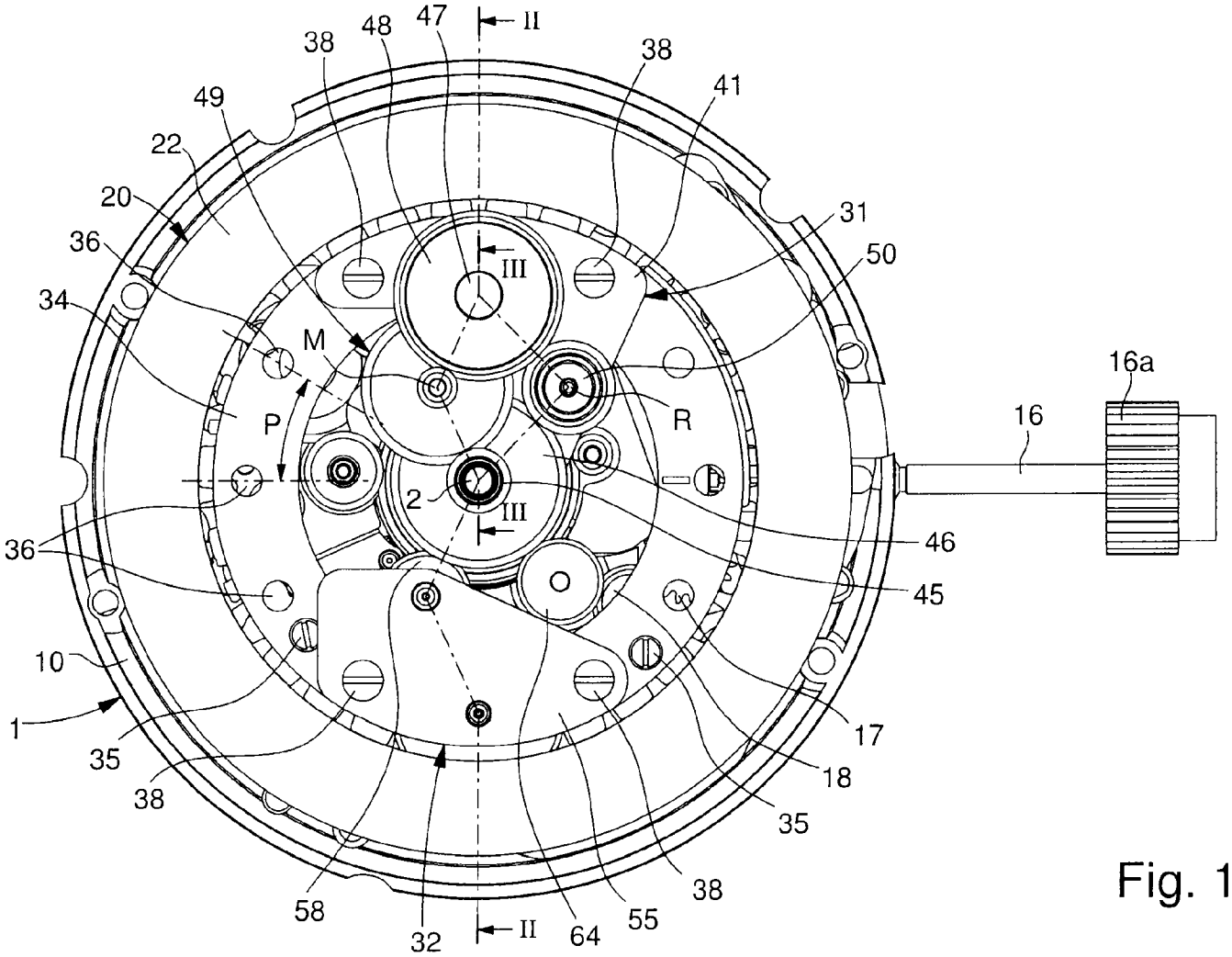
FIG. 1 is a schematic front view of a display assembly according to a first embodiment of the invention, including two time display devices.

In the example of FIG. 1, it is seen that each display device 31, 32 is fixed to rail 34 by means of two screws 38 associated with screw feet 37, and that six of orifices 36 remain free, which means either that these devices can be moved or several additional display devices can be secured. It is thus immediately clear that, once the first display device 31 is fixed to rail 34, the invention advantageously offers many more possibilities for placing the second display device 32 in different positions along rail 34, as the designer chooses, due to the support members formed by orifices 36 which are still free. This will appear hereinafter with reference to FIGS. 16 and 17.

Of course, if the designer wished to have a larger number of possible positions for the devices, he could simply use a rail with a larger number of orifices 36 having a pitch P of less than 30° or give the orifices an oblong shape, offering an infinite number of positions. Further, he could provide another method of fixing some devices, for example if a device has a frame overlapping the rail and has a lateral screw grip, with or without notches on the rail. It will also be noted that rail 34 could be discontinuous, i.e. include one or several sections in the arc of a circle, so as to free some spaces, for example for the passage of a functional connection between a display device and control stem 16 or the calendar driving member of basic movement 1.

Figure 2:
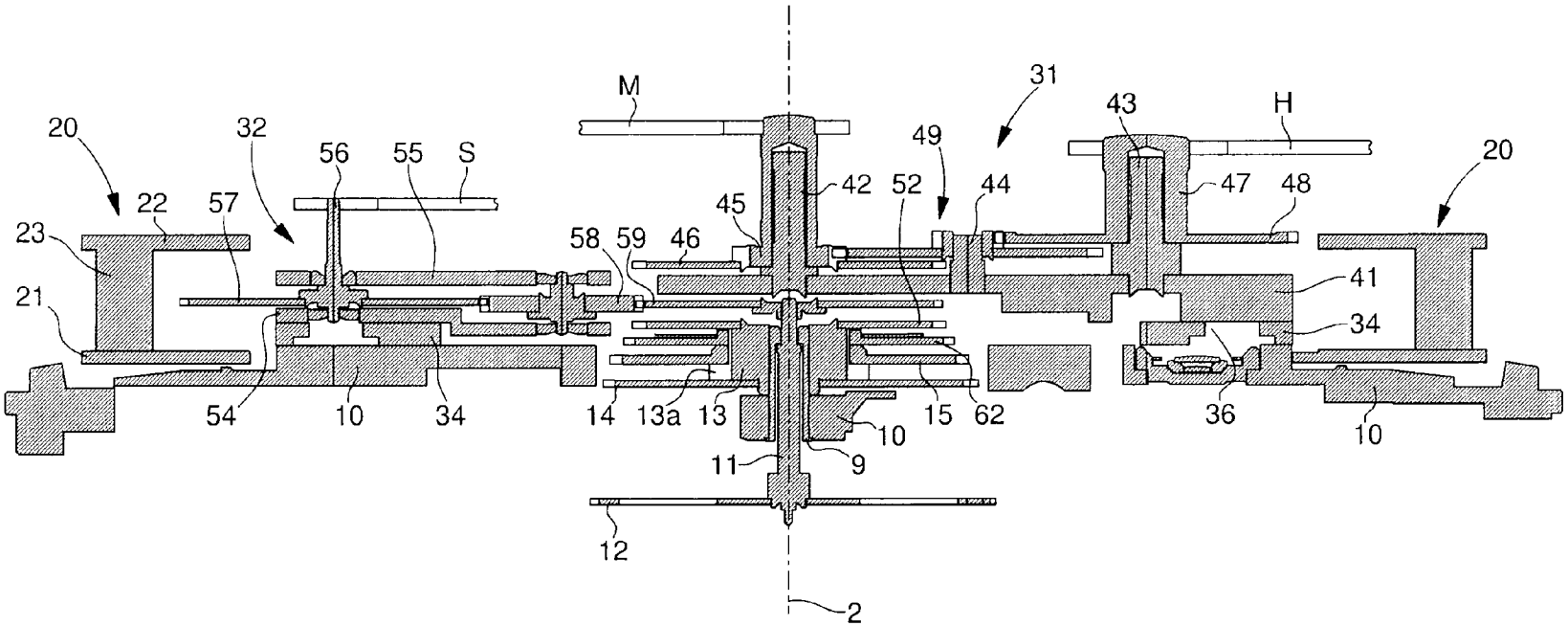
FIG. 2 is a schematic cross-section along the line II-II of FIG. 1 via point M.
Figure 3:
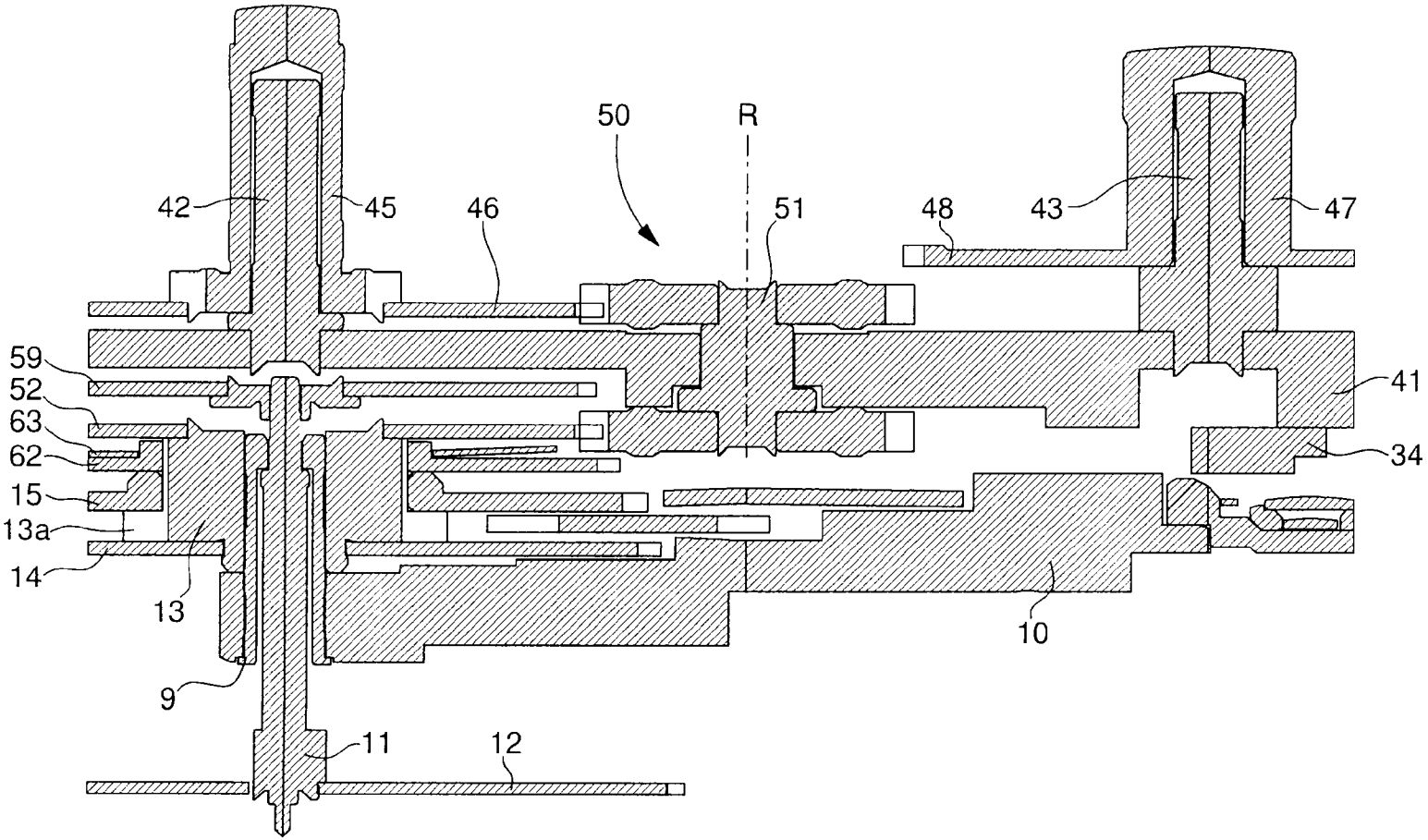
FIG. 3 is an enlarged schematic cross-section along the line III-III of FIG. 1 via point R.
Figure 4:
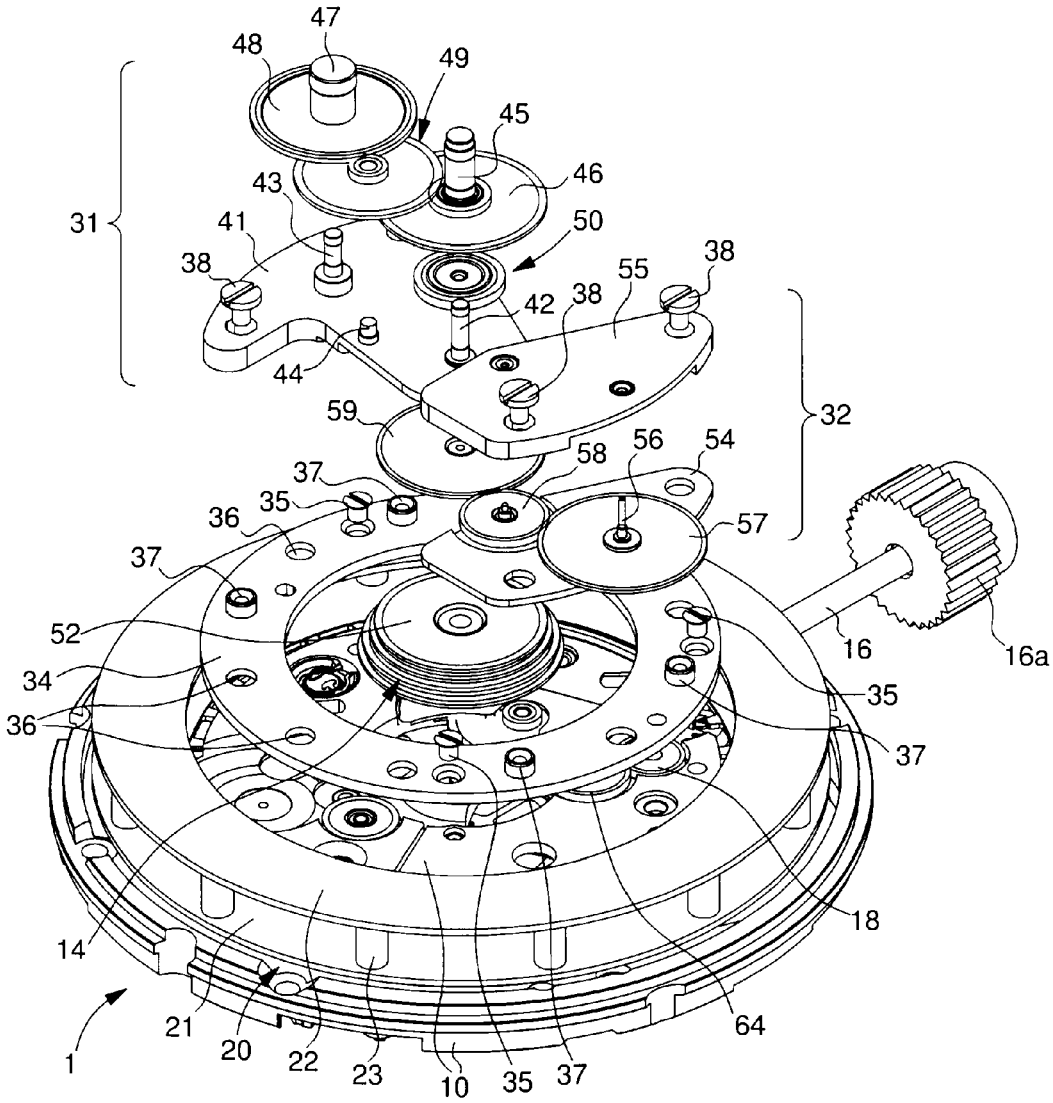
FIG. 4 is an exploded perspective view of a display assembly according to a first embodiment of the invention.

Each of display devices 31, 32 includes a frame called a carriage or "chariot" here, because it can be positioned by movement along rail 34. This chariot, fixed to rail 34 by screws 38 engaging in screw feet 37, may be likened to a plate for the mechanical components which form each display device 31, 32. FIGS. 2 and 3 show that chariot 41 of hour/minute display device 31 is provided with three arbours 42, 43 and 44, intended to be used as pivot pins. Thus, arbour 42 carries a top cannon-pinion 45 provided with minute hand M and a wheel 46. Arbour 43 receives a pipe 47 provided with hour hand H and a top hour wheel 48. Finally, arbour 44 carries a top motion work 49 connecting the pinion of the top cannon-pinion 45 to the top wheel 48 with the usual transmission ratio.

Chariot 41 further includes a bearing carrying arbour 51 (visible in FIG. 3) of a double intermediate wheel 50, which connects wheel 46 of top cannon-pinion 45 to a drive wheel 52 fixed to cannon-pinion 13 of basic movement 1. Since rail 34 and its row of orifices 36 are centred on output arbour 2 of movement 1, double intermediate wheel 50 is meshed with wheel 52 in all of the possible positions of display device 31 on rail 34. Of course, the transmission ratio of double intermediate wheel 50 is 1:1 so that hands M and H rotate at the same speed as wheels 14 and 15 of basic movement 1.

Chariot 54 of display device 32 carries a bridge 55. This bridge 55 and chariot 54 are provided with two pairs of jewels for respectively carrying a small seconds arbour 56 and an intermediate wheel 58. As seen in the example of FIG. 2, arbour 56 is fitted with a wheel 57 and the small seconds hand S, whereas intermediate wheel 58 is meshed with wheel 57. Intermediate wheel 58 is also meshed with a seconds drive wheel 59 fixed to the tip of the seconds arbour 11 in place of the usual central seconds hand. Thus, as for the first display device 31, whatever the position of the second display device 32 on rail 34, intermediate wheel 58 remains meshed on wheel 59. Preferably, wheels 57 and 59 have the same diameter so that they can rotate at the same speed.

For cases in which, in addition to the devices 31 and 32 described here, display device 30 has other display devices which might require correction, for example a second time zone display, calendar or moon phase display, a central corrector wheel 62 is rotatably mounted on cannon-pinion 13 of basic movement 1 and axially wedged using a spring 63 (referenced in FIG. 3). It may be driven by corrector wheel 17 via the train of two corrector intermediate wheels 18 and 64 mounted on plate 10 of basic movement 1. Thus, a display device requiring a correction function can be mounted anywhere on rail 34, while remaining meshed both with central corrector wheel 62 and with the wheel that normally drives the device, for example hour wheel 15.

It is observed that the system combining the rail as intermediate support with several display devices not only allows the display members of these devices to be placed in different positions, without changing any components, but also allows one display device to be replaced by a different device so as to vary the manufacturer's range of products. It may be a device displaying another magnitude, but also a device displaying the same magnitude, but in a different way, for example with a disc, drum, retrograde hand or even with an ordinary seconds hand in order, for example, to display a time zone with a fixed time difference.

Figure 5:
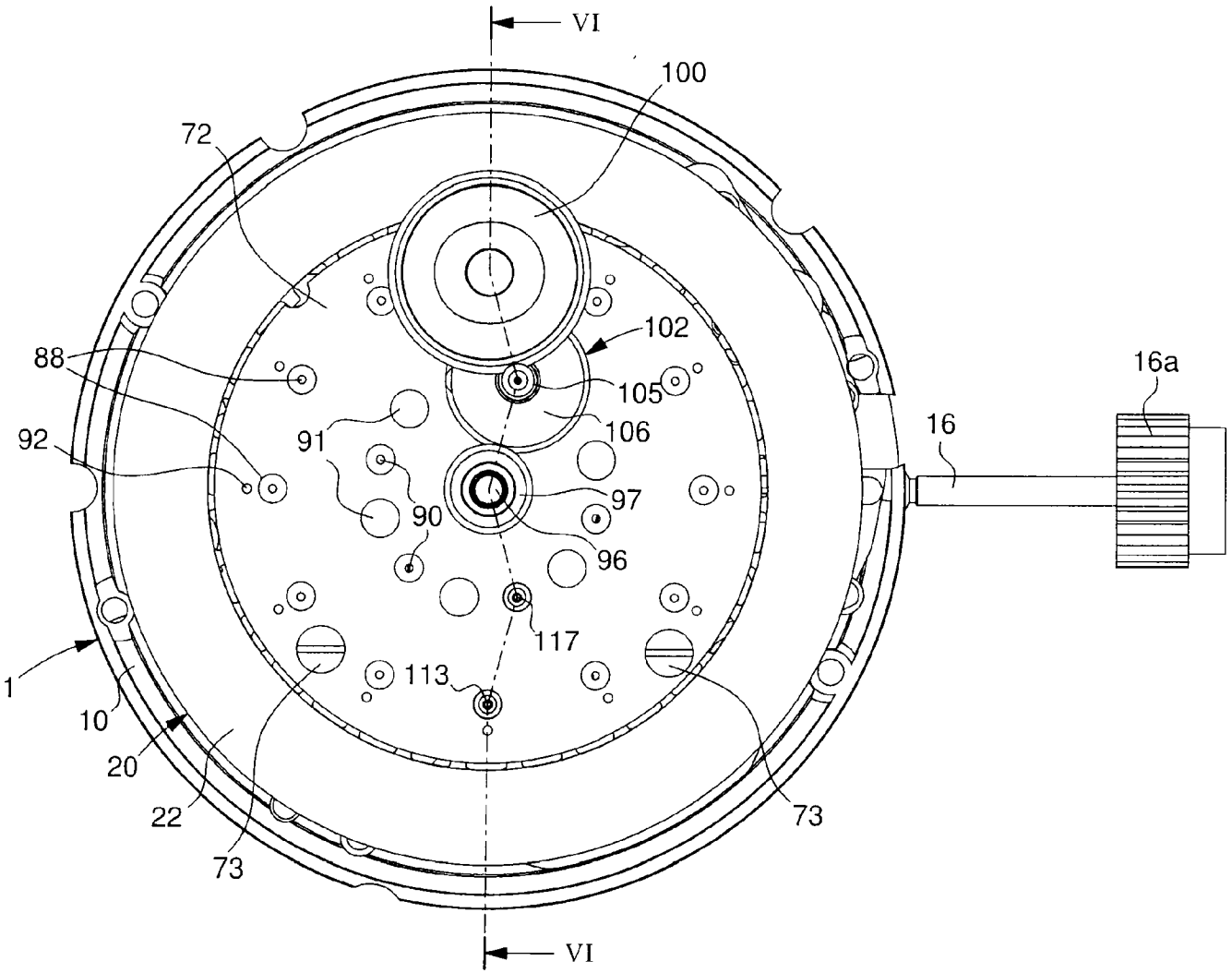
FIG. 5 is a schematic front view of a display assembly according to a second embodiment of the invention, including two time display devices.
Figure 6:
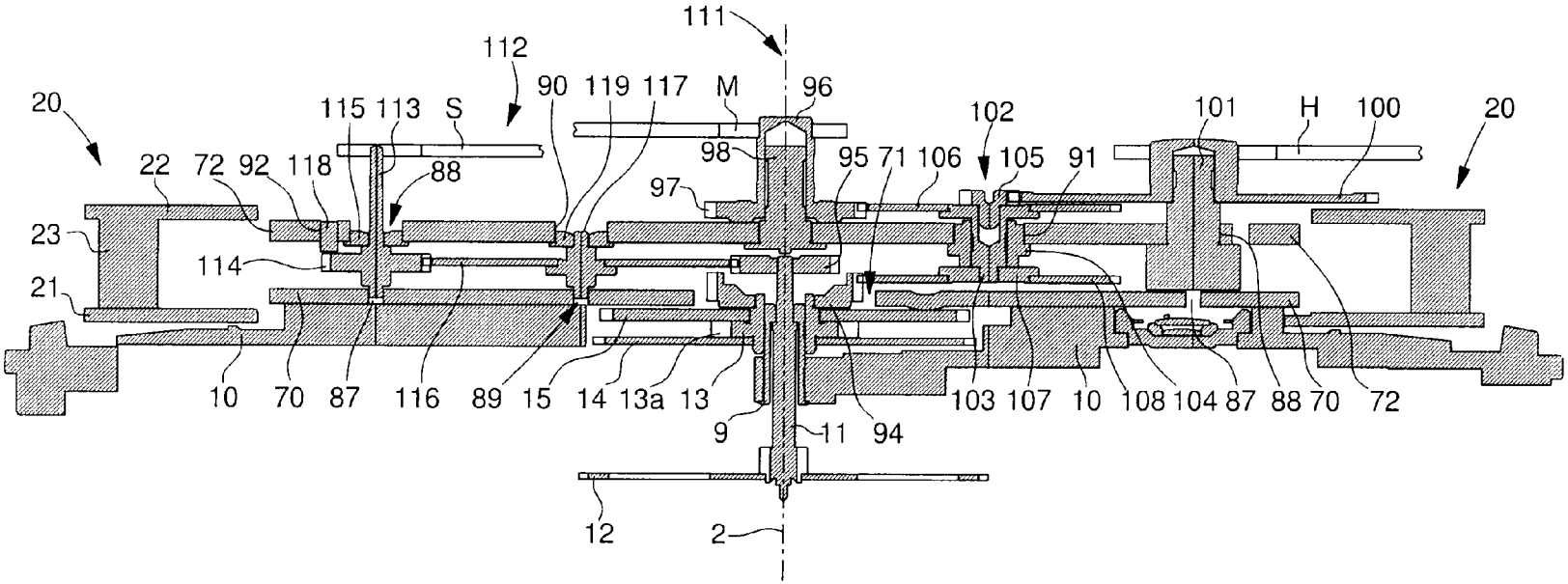
FIG. 6 is a schematic cross-section along the line VI-VI of FIG. 5.
Figure 7:
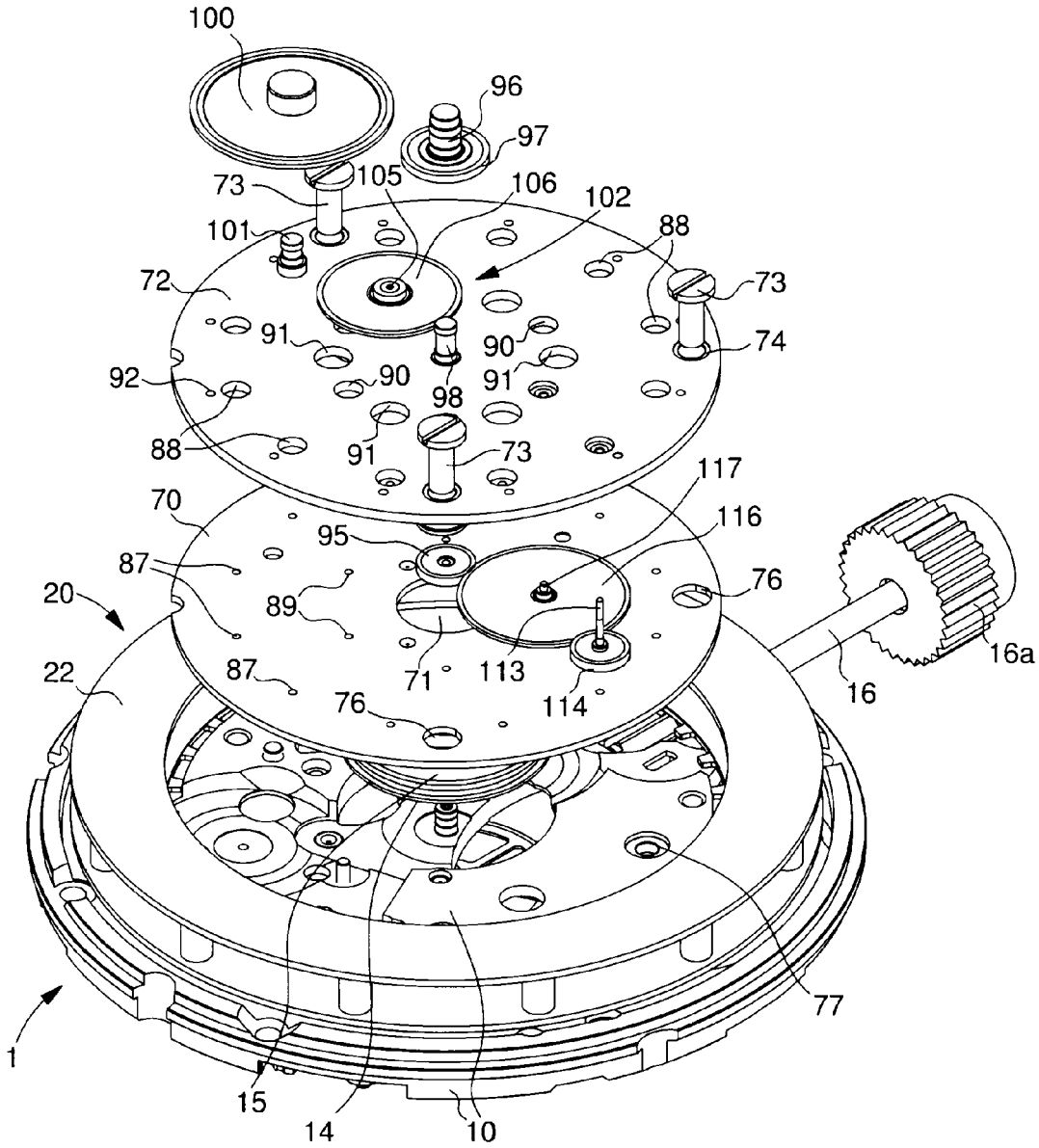
FIG. 7 is an exploded perspective view of a display device according to a second embodiment of the invention.

According to a second embodiment of the invention, an example of which is shown in FIGS. 5 to 7, the intermediate support of the display assembly is made in the form of a frame 70 fixed to a fixed part 10, in this case the plate, of basic movement 1, so as to at least partially overlap. In the example illustrated in FIGS. 5 to 7, frame 70 takes the form of a circular plate, with a central aperture 71 opposite the mechanical output of basic movement 1.

Preferably, movement 1 is the same as that of the first embodiment and it is also fitted with the same date display using two-staged ring 20, the top disc 22 of which carries the dates appearing in aperture D shown in FIGS. 8 to 18.

The elements of the time display assembly of the watch are mounted on frame 70 or, preferably, between frame 70 and at least one bridge 72. In the example illustrated in FIGS. 5 to 7, a single bridge 72 is used, in the form of a substantially circular plate of the same diameter as frame 70.

Each bridge 72 and frame 70 are positioned and consequently fixed together to a fixed part 10, in this case the plate, by means of several screws 73, which each pass in succession through a hole 74 in bridge 72, a tubular strut (not shown) defining the space between each bridge 72 and frame 70, and a hole 76 in frame 70. Preferably, each screw 73 is held in plate 10 by being screwed into a threaded hole 77 in plate 10. The positions of holes 77 do not follow any particular arrangement. Thus, the positions should be preferably chosen in accordance with the available areas on fixed part 10 of movement 1.

According to the second embodiment, frame 70 and bridge 72 include several series of support members for mounting the mechanical elements of the display assembly. In the examples illustrated in FIGS. 5 to 7 the support members are formed by holes. The arrangement of these support members is regular, based, in the example shown in FIG. 18, on six radial axes 81 to 86 separated from each other by an angular pitch P=30° as in the first embodiment.

According to this arrangement, there is a crown of twelve pivot holes 87 in frame 70, on a circular of relatively large diameter, and vertical to said holes, a crown with twelve wider holes 88 in bridge 72. The wider diameter of holes 88 enables various elements to be received as required, particularly an arbour, or a bush type bearing or watch jewel, as will be seen hereinafter.

On a circle of smaller diameter, a second series of six pivot holes 89 is further provided in frame 70, arranged substantially in a crown shape and vertical thereto, there is a second crown of six wider holes 90 in bridge 72. Preferably, the second series of holes 89 is mounted in a quincunx arrangement with the first series of holes 87 and is closer to output arbour 2.

Similarly on bridge 72, the second series of holes 90 is mounted in a quincunx arrangement with the first series of holes 88 and is closer to output arbour 2. It is thus clear that a wheel mounted using one of the pairs of holes 89 and 90 can mesh with a wheel set carried by one and/or the other of the two adjacent pairs of holes 87 and 88.

As illustrated in FIGS. 5 and 7, bridge 72 may also include a third crown-shaped series of six holes 91 each formed between two holes 88 and a fourth crown-shaped series of twelve holes 92, each being radially aligned with a hole 88 between the latter and the external edge of bridge 72. The third and fourth series are intended to increase the modularity and/or add functionalities to the display devices as is explained hereinafter.

The mechanical output of basic movement 1 is more particularly shown in FIG. 6. The following parts are seen again: fixed part 10, in this case the plate, seconds arbour 11 provided with the seconds wheel 12 and guided by means of a fixed tube 9, cannon-pinion 13, cannon-pinion drive wheel 14 and hour wheel 15, driven by toothing 13*a* of cannon-pinion 13 via the usual motion work (not visible in the drawings). The cannon-pinion 13 used here replaces that of the original movement, since it is shorter. The top end thereof is provided with a top drive wheel 94 of small enough diameter to occupy central aperture 71 of frame 70. Above wheel 94 there is a seconds drive wheel 95, fixed to the end of arbour 11.

Frame 70 and bridge 72 carry two time display devices 111 and 112 driven by the output of movement 1 described hereinbefore. In the example illustrated in FIGS. 5 to 7, the first "regulator" type display device 111, like device 31 of the first embodiment, displays the time by off-centre hand H and the minute by central hand M. Hand M is carried by a top cannon-pinion 96 provided with a toothing 97 and pivoting on an arbour 98 fixed to the centre of bridge 72. Hour hand H is carried by the pipe of a wheel 100 which pivots on an arbour 101 mounted in one of holes 88 in bridge 72, in this case the hole located towards the top of the watch dial.

The hour and minute wheel sets 100, 96 of the display device 111 are connected by a motion work wheel set 102 having a motion work arbour 103 rotatably mounted in a guide tube 104 driven into a hole 91 in bridge 72. Arbour 103 carries a motion work pinion 105 meshed with wheel 100, a top plate 106 in mesh with the toothing of the top cannon-pinion 96, and a hub 107 integral with a bottom plate 108 which is in mesh with top drive wheel 94 of cannon-pinion 13 of basic movement 1. The two plates 106 and 108 are identical, to simplify fabrication, and form a double intermediate wheel playing the same part as double intermediate wheel 50 of the first embodiment.

Of course, the motion work transmission ratio between the top cannon-pinion 96 and wheel 100 is preferably equal to 1:12. However, if hour hand H were required to make a revolution in only 24 hours, the diameters of wheel 100 and pinion 105 would simply need to be altered.

In the example illustrated in FIGS. 5 to 7, the second time display device 112 is of the small seconds type, with the seconds hand S off-centre in a similar manner to device 32 of the first embodiment. This hand S is carried by an arbour 113. The latter is provided with a pinion 114 and is guided between a bearing 115 (bush or jewel) driven into one of holes 88 in bridge 72 and one of holes 87 in frame 70.

Small seconds pinion 114 is connected to the drive wheel 95 via an intermediate wheel 116, whose arbour 117 pivots in one of holes 89 in frame 70 and a bearing 119 (bush or jewel) driven into one of holes 90 in bridge 72. Drive wheel 95 and pinion 114 preferably have the same diameter, in order to rotate at the same speed.

According to a preferred embodiment of the invention illustrated in FIG. 6, a magnetised pin 118 is driven into one of holes 92 opposite pinion 114. Pin 118 advantageously acts on the toothing of pinion 114 so as to brake said pinion when one of the teeth thereof is plumb with pin 118 in order to decrease the oscillations of hand S.

It is observed that the two time display devices 111 and 112 respectively perform the same functions as the two display devices 31 and 32 of the first embodiment and may also each occupy twelve distinct positions, shifted by 30° steps from each other over the circumference of the watch dial. Simple solutions may also allow other positions. For example, in the second embodiment, more or fewer holes 74, 76 can be provided in bridge 72 and frame 70, so as to increase or decrease the number of securing screws 73. By way of example, the play could then be shifted by 15 degrees (0.5·P) or 45 degrees (1.5·P) relative to the first embodiment.

The example illustrated in FIGS. 5 to 7 shows a relatively thin construction of a display assembly according to the invention. This low height is permitted notably because no corrector is provided here in the display assembly itself. There is only the corrector of basic movement 1. Nonetheless, the second embodiment could also be devised with a central corrector wheel such as wheel 62 described hereinbefore, for correcting, for example, the indication of a second time zone or a calendar display carried by frame 70 and bridge 72.

It will also be noted that bridge 72 could be replaced by a different bridge cooperating with the same frame 70, as required, or even by several distinct bridges, without this resulting in a large increase in the number of ebauches stored by the manufacturer. Likewise, the possible use of two frame models as required would not greatly complicate the manufacture and storage of parts, compared to the prior solution which consisted in manufacturing and storing a plurality of complete display devices.

Figure 8:
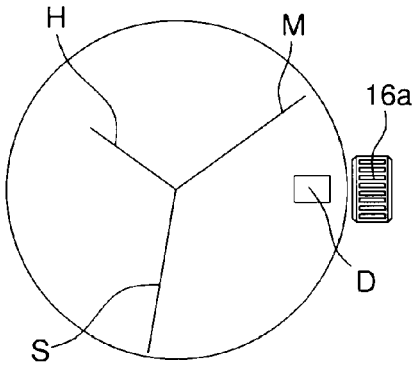
FIGS. 8 to 18 are diagrams showing various display configurations made possible by the invention with the same timepiece movement in the three embodiments.
Figure 9:
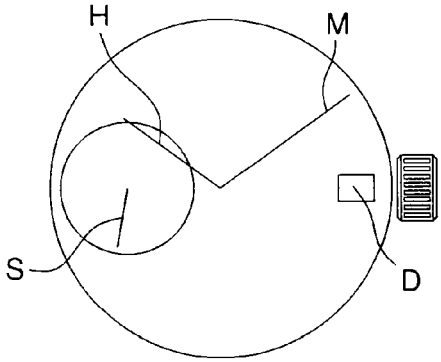

Those skilled in the art will understand that, in the second embodiment of the invention, the time display device 111 can easily be altered so as to form a device displaying the hour, minute and second in the conventional manner with coaxial hands H, M, S at the centre, i.e. the configuration in FIG. 8. Referring now to FIG. 6, it is noted that, without altering the motion wheel set 102, hour wheel 100 could be placed on a pipe rotating about cannon-pinion 96, while remaining in mesh with motion work pinion 105 owing to the equal distance between the holes in bridge 72. Centre seconds hand S may be carried in the usual manner by an arbour passing through arbour 98 and coupled to arbour 11 of basic movement 1. If, conversely, small seconds display device 112 is retained, the configuration of FIG. 9 is obtained.

Figure 10:
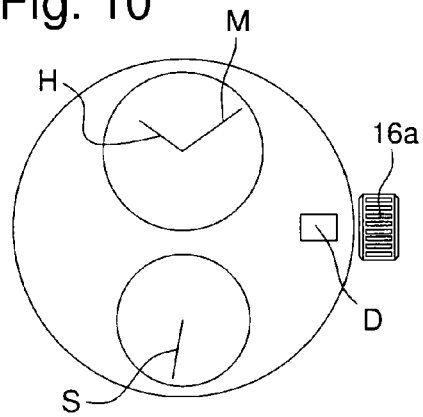

Likewise, by retaining small seconds display device 112, a conventional hour and minute display device can be provided in an off-centre position on arbour 101, without any change to motion work wheel set 102. Arbour 101 simply needs to be changed so that it acts as a pivot for a cannon-pinion meshing with plate 106 and carrying around it the pipe of hour wheel 100. The configuration of FIG. 10 is thus obtained.

FIGS. 11 to 15 show schematically other time display configurations via hour hand H, minute hand M and seconds hand S, which can easily be achieved on the same basic movement 1 by using the present invention. It will be noted that the date display in aperture D may or may not be present, and that aperture D may be in numerous different positions, particularly to be combined in a harmonious manner with the various graduations associated with the display members, for example such as hands H, M, S.

As explained for the second embodiment hereinbefore, it is important to note that all of the configurations shown in FIGS. 8 to 18 may also be obtained using the principles of the first embodiment of the invention, namely, display devices including chariots of the type referenced 41, 54, which can be placed in various positions on a support rail of the type referenced 34 which is at least partially circular, i.e. annular or in the arc of a circle.

Figure 16:
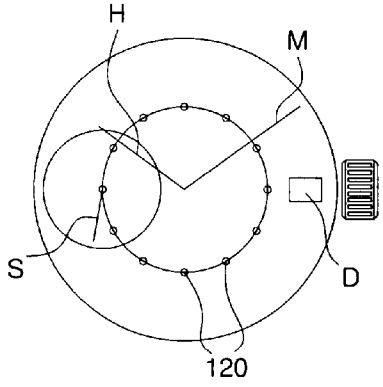
Figure 17:
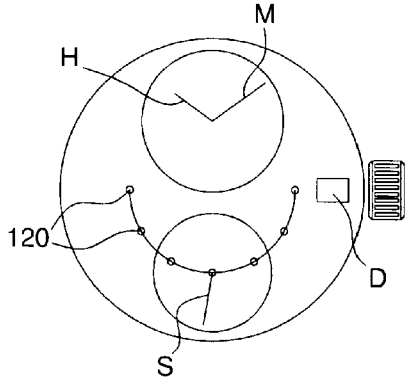
Figure 18:
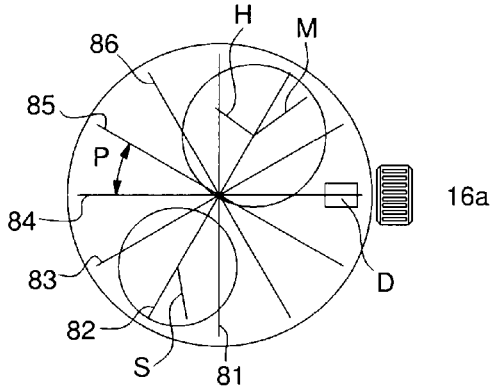

FIGS. 16 to 18 give a glimpse of the very extensive modularity that the present invention can offer for a watch display. FIG. 18 shows that, when the angular pitch P is 30° in conformity with the two embodiments described hereinbefore, an arrangement along six main axes 81 to 86 is already possible with the same common basic movement model 1.

According to a second example illustrated in FIG. 16 with a conventional time display with hands H and M at the centre and a small seconds hand S, the latter can occupy any of the twelve positions 120 corresponding to axes 81 to 86, without changing any of the mechanical parts. Incidentally, the date aperture D may also occupy any position, such as, notably, a permanent position opposite the small seconds relative to arbour 2, if desired. Moreover, with the small seconds S in a position 120, it remains possible to set in place one or several additional display devices.

In another example illustrated in FIG. 17, the display assembly includes an off-centre display with hands H and M. Hence, the small seconds S may occupy up to seven different positions 121 along an arc centred on output arbour 2 of basic movement 1 without changing any of the mechanical parts. Incidentally, the date aperture D may also occupy any position. Further, if the small seconds display S is placed towards the most lateral positions 121, it is also possible to envisage setting an additional display device in place.

In the FIG. 18 view, it can immediately be seen that, with a conventional movement 1 output and without changing any of the mechanical parts, it is possible to obtain many more positions relative to axes 81 to 86, to obtain original, or at least unusual, display configurations. It is only the dial that changes, which provides an immediate economical advantage compared to the current solution of making alterations to the module.

Further, advantageously according to the invention, it is also clear that, for a given orientation of the display, the designer may choose to place control stem 16 and crown 16*a* thereof in twelve different directions without any alteration to basic movement 1, or to the display assembly, i.e. without changing any of the mechanical parts.

The description hereinbefore demonstrates that the present invention allows numerous different configurations of a time or other display with a very limited set of parts. Those skilled in the art will understand that the invention offers the same advantages for other types of display, driven from a basic movement, particularly chronograph, calendar, power reserve or moon phase displays. It also makes it easy to combine a common type of basic movement with special types of display, for example with retrograde hands, without transforming the main mechanical components of the watch.

Figure 19:
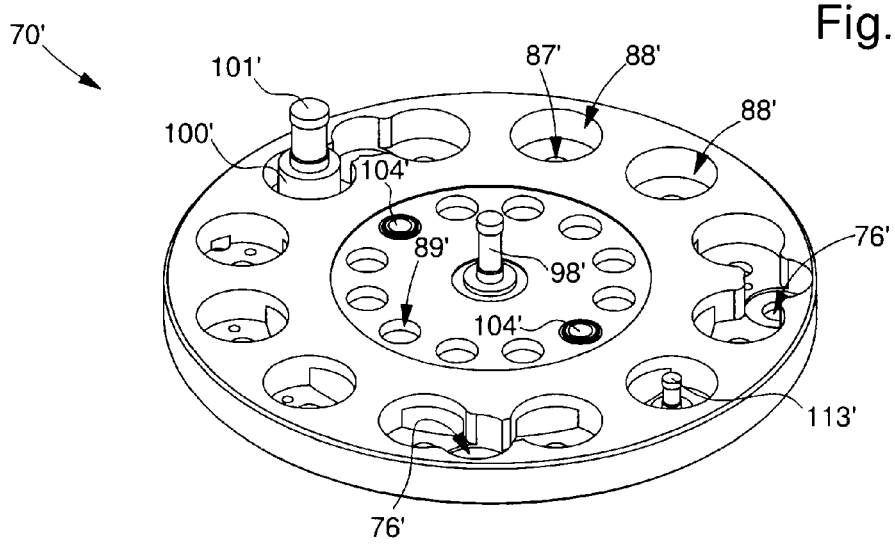
FIGS. 19 and 20 are diagrams of a third embodiment of an intermediate part according to the invention.
Figure 20:
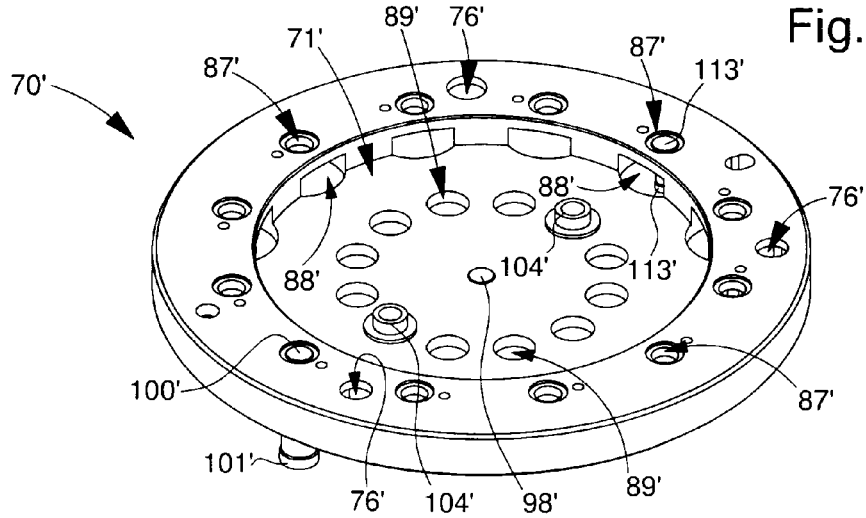

Further, in order to limit the number of ebauches and in accordance with a third embodiment, it would also be possible to use a thicker intermediate support like a frame 70' that simultaneously includes the features of frame 70 and bridge 72 of the second embodiment. A non-limiting example of this third embodiment is shown in FIGS. 19 and 20. According to this third embodiment, the pivoting of the wheel sets is preferably achieved in a similar manner to motion work wheel set 102 of the second embodiment. Consequently, this third embodiment does not require any additional bridges.

For improved comprehension of the example of FIGS. 19 and 20, the references used are similar to those of the corresponding elements of the second embodiment, particularly as regards those of FIG. 7. Thus, the frame 70' is seen, which can be secured to a fixed part 10 of movement 1, by means of several screws which each pass through a hole 76' in frame 70'. According to the third embodiment, frame 70' includes several series of support members for mounting the mechanical elements of the display assembly.

In the example illustrated in FIGS. 19 and 20, the support members are formed by holes in a regular arrangement, based, in the example shown in FIG. 18, on six radial axes 81 to 86. The holes are separated from each other by an angular pitch P=30°, as in the first two embodiments.

According to this arrangement, a crown with twelve positioning holes 87' is provided in the bottom part of frame 70', which each open onto a wider hole 88' in the top part of frame 70'. Holes 88' thus also form a crown with twelve wider holes 88'. The diameter of holes 87', 88' can receive various elements as required as in the second embodiment.

On a circle of smaller diameter, a second series of twelve positioning holes 89' is further provided in the bottom part of frame 70', also arranged substantially in a crown-shape. In the example of FIG. 20, a recess 71' is formed in the top part of frame 70'. Recess 71' is intended to be mounted opposite the mechanical output and communicates tangentially with holes 88'. It is clear that a wheel set present in a hole 88' can thus be meshed with a wheel set positioned in recess 71' and particularly fixed in the hole 89' opposite said hole 88'.

By way of example, as illustrated in FIGS. 19 and 20, an arbour 113' has been positioned in a hole 88' by fixing one of the ends thereof in the corresponding hole 87'. First 98' and second 101' arbours have also been added, respectively secured in a central hole in the top part of frame 70' and in another hole 87' to show two levels of pivoting in a similar manner to the second embodiment. Thus, arbour 101' includes a foot 100' fixed in a hole 87' to cause arbour 101' to project from the top part of frame 70'. Finally, two guide tubes 104' have been mounted in two distinct holes 89'.

Consequently, as in the first and second embodiments, owing to holes 87', 88' and 89', the third embodiment also provides great modularity and/or adds functionalities to the display devices as is explained hereinbefore.

Further, according to a variant of the invention and in the three embodiments, it is possible to envisage one part of display assembly 30 forming a single-piece with fixed part 10 of movement 1. Thus, it is possible to imagine intermediate part 34, 70, 72 and/or 70' of display assembly 30 being totally or partially integral with the fixed part 10 used for mounting display assembly 30 such as, for example, the plate of movement 1. Moreover, the fixed part 10 of movement 1 is not limited to the plate thereof but may also be a bridge or even a part of the drive mechanism for the calendar display member.

It should also be noted that, advantageously according to the invention, in the three embodiments the symmetry of the intermediate means 34, 70, 72, 70', combined with that of securing holes 76, 76' also allows the position of the display members to be altered without altering the assembly of display devices 31, 32, 111, 112. Thus, in order to screw the display assembly into a new position, screws 35, 73 simply need to be removed and then display assembly 30 has to be rotated relative to timepiece movement 1. Consequently, more threaded holes 77 may be provided, also in the fixed part 10 of timepiece movement 1 to allow more possible positions.

Finally, the calendar element is not limited to a date ring 20 with two annular discs 21 and 22 connected by pillars 23. It is important simply to make a space relative to the plane of the drive mechanism of basic movement 1. This space substantially corresponds to the thickness of display assembly 30 so that said calendar display is presented as close as possible to said analogue display, i.e. in the case of FIGS. 8 to 18, plumb with aperture D.

Figure 21:
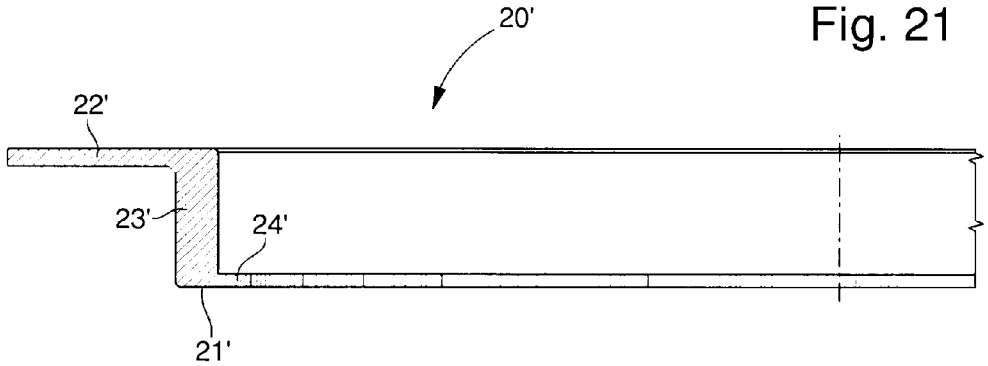
FIG. 21 is a cross-section of an alternative embodiment of a calendar display member according to the invention.

Consequently, according to an alternative of the invention, the date element may be a cylinder whose internal diameter includes a toothing able to mesh with said drive mechanism of basic movement 1 and the height of which extends into said space. It is also possible to hollow out a portion of the cylinder as illustrated in FIG. 21 in order to make this alternative lighter. A single-piece date ring 20' is thus obtainable, with a substantially S-shaped section, including a top part 22' carrying the date graduations and a bottom part 21' including a toothing 24'. The bottom 21' and top 22' parts may also be connected by a whole or partially recessed wall 23'.

What is claimed is:

1. An analogue display timepiece, comprising:

a single timepiece movement provided with a mechanical output, located on an output arbour of the single movement, and a display assembly provided with at least one display device driven by said mechanical output of the single movement, wherein the display assembly is separate from the single timepiece movement and linked to a fixed part of the single movement by a support for the display assembly configured to support said at least one display device in several positions around the output arbour of the single movement, wherein the support for the display assembly includes an intermediate support secured to the fixed part of the single timepiece movement and provided with support members allowing said at least one display device to be mounted in several positions on the intermediate support, said at least one display device includes a frame, and the intermediate support is sandwiched between the frame of the at least one display device and the fixed part of the single timepiece movement.

2. The timepiece according to claim 1, wherein said mechanical output includes a seconds arbour surrounded by a cannon-pinion.

3. The timepiece according to claim 1, wherein said display assembly includes at least two display devices.

4. The timepiece according to claim 1, wherein the intermediate support includes an at least partially circular rail, which is centered on the output arbour of the single timepiece movement.

5. The timepiece according to claim 4, wherein said support members include orifices fitted to the rail for at least one of securing and positioning each display device.

6. The timepiece according to claim 5, wherein the orifices are arranged around the output arbour at a predetermined angular pitch so as to offer many possibilities for positioning each display device.

7. The timepiece according to claim 4, wherein each display device is fixed to said rail and is in mesh with a wheel of said mechanical output to display at least one time value.

8. The timepiece according to claim 1, wherein the intermediate support includes a frame having a central aperture opposite said mechanical output.

9. The timepiece according to claim 8, wherein at least one bridge is mounted at a distance from the frame, with at least one display device being mounted in the space between said at least one bridge and said frame.

10. The timepiece according to claim 9, wherein said support members include at least one series of holes in said frame and at least one series of holes in said at least one bridge for at least one of securing and positioning each display device.

11. The timepiece according to claim 10, wherein the series of holes are distributed around the output arbour at a predetermined angular pitch so as to offer many possibilities for positioning each display device.

12. The timepiece according to claim 10, wherein said support members include a second series of holes in said frame and in said at least one bridge at a predetermined angular pitch so as to offer even more possibilities for positioning each display device.

13. The timepiece according to claim 9, wherein the frame and said at least one bridge are fixed together to the fixed part by screws that each pass through said at least one bridge and the frame.

14. The timepiece according to claim 8, wherein said support members include at least one series of holes in the bottom part of the frame and at least one series of holes in the top part of the frame for at least one of securing and positioning each display device.

15. The timepiece according to claim 14, wherein the series of holes are distributed around the output arbour at a predetermined angular pitch so as to offer many possibilities for positioning each display device.

16. The timepiece according to claim 14, wherein said support members include a second series of holes in the top part of the frame so as to each communicate with one of said holes formed in the bottom part of the frame.

17. The timepiece according to claim 14, wherein the frame is fixed to the fixed part by screws in at least one hole in the frame.

18. The timepiece according to claim 10, wherein said support members are configured to receive at least one of an arbour, a tube, and a bearing.

19. The timepiece according to claim 8, wherein each display device is in mesh with a wheel of said mechanical output to display at least one time value.

20. The timepiece according to claim 1, wherein at least one part of the display assembly is integral with the fixed part of the single timepiece movement.

21. The timepiece according to claim 6, 11 or 15, wherein the angular pitch is less than or equal to 30°.

22. The timepiece according to claim 1, wherein the single timepiece movement includes a drive mechanism for a calendar display member and the calendar display member is shifted relative to the plane of said drive mechanism by a space that substantially corresponds to the thickness of the display assembly, so that the display of said calendar is presented as close as possible to said analogue display.

* * * * *